United States Patent [19]

Gross

[11] 4,213,108

[45] Jul. 15, 1980

[54] SWITCH STRUCTURE HAVING PARTS EMBEDDED IN PLASTIC

[76] Inventor: Harry R. Gross, 127 Carpenter St., West Branch, Mich. 48661

[21] Appl. No.: 922,994

[22] Filed: Jul. 10, 1978

Related U.S. Application Data

[62] Division of Ser. No. 632,405, Nov. 17, 1975, Pat. No. 4,112,576.

[51] Int. Cl.[2] ..... H01H 50/02

[52] U.S. Cl. ..... 335/131; 335/202

[58] Field of Search ..... 335/202, 187, 131, 126, 335/251, 255, 260; 29/622

[56] References Cited

U.S. PATENT DOCUMENTS

| | | | |
|---|---|---|---|
| 3,217,124 | 11/1965 | Terry | 335/187 |
| 3,516,035 | 6/1970 | Josenhans | 335/202 |

*Primary Examiner*—Harold Broome

*Attorney, Agent, or Firm*—Barnes, Kisselle, Raisch & Choate

[57] ABSTRACT

A solenoid and electric terminal heads are embedded in plastic by injection molding. Die faces accurately position and orient contact surfaces on the heads relative to the solenoid and contacts on the solenoid plunger, eliminating subsequent machining. The solenoid windings and lead wires are encapsulated by plastic injected in the molding process through openings in the coil casing. Portions of the lead wires outside of the casing and contact posts connected thereto are also embedded in the plastic. Injection molded walls guide axial movement of a rectangular contact member with the plunger and prevent its rotation out of alignment with the terminal heads. A fibrous washer compresses axially under the die force to compensate for cumulative axial tolerances of the solenoid and terminal heads for accurately positioning the bottom of the plunger opening relative to the contact surfaces on the terminal heads. Engagement of the plastic with the terminals and contact posts provides moisture-proof seals which cooperate with a plastic cap welded to the molded plastic to provide a moisture-proof housing.

32 Claims, 19 Drawing Figures

FIG. 12
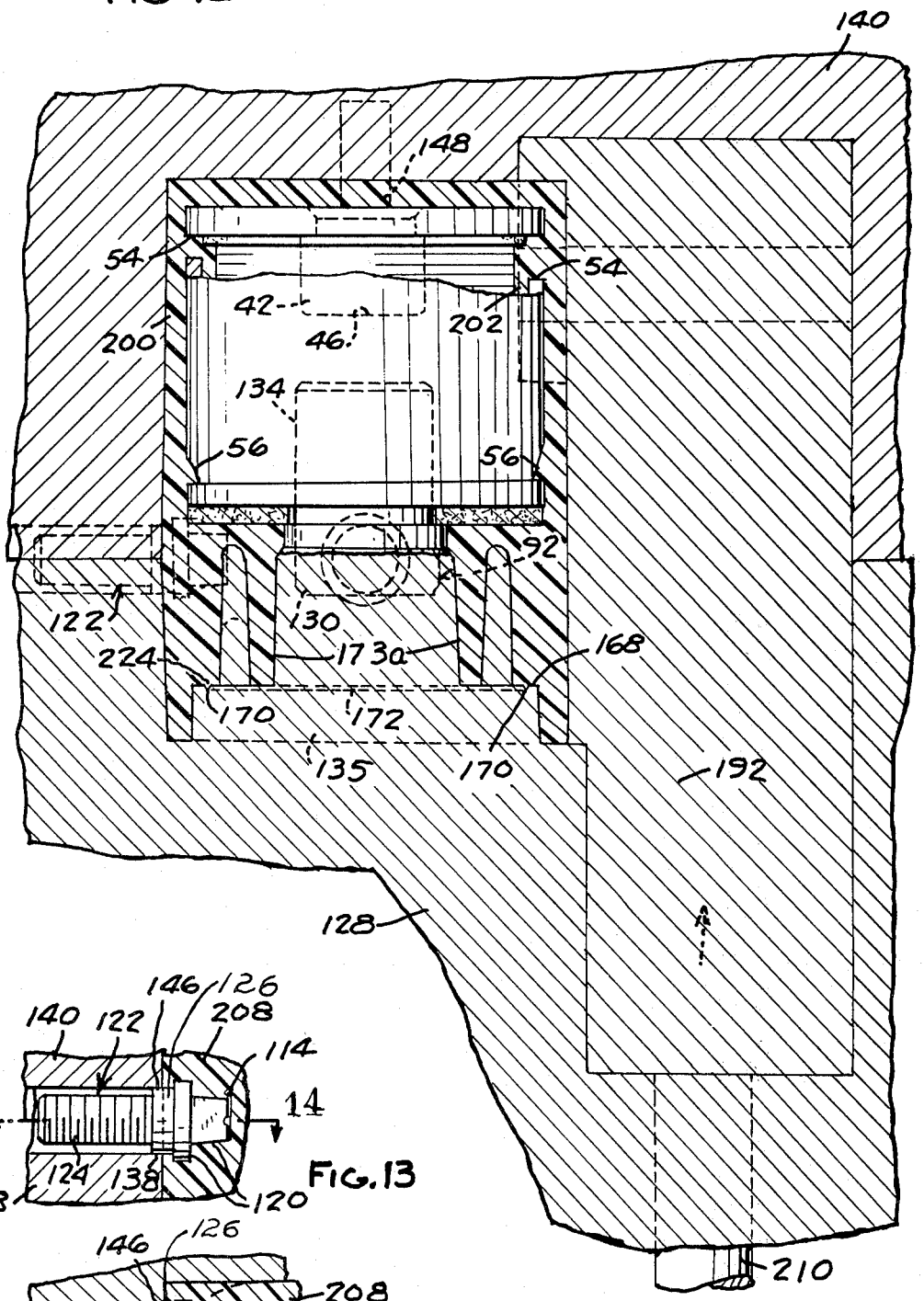
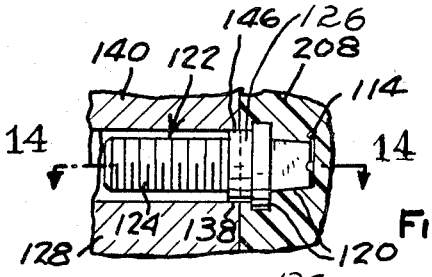
FIG. 13
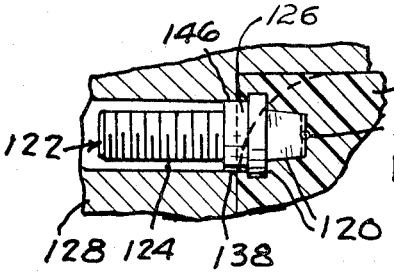
FIG. 14

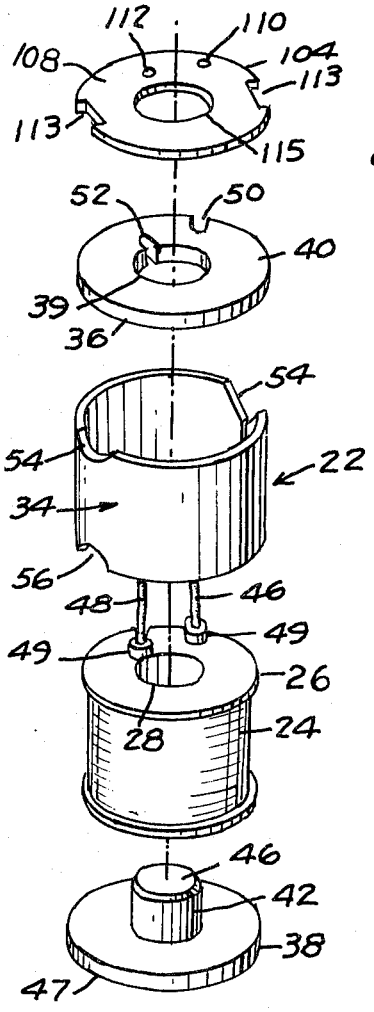
FIG. 15
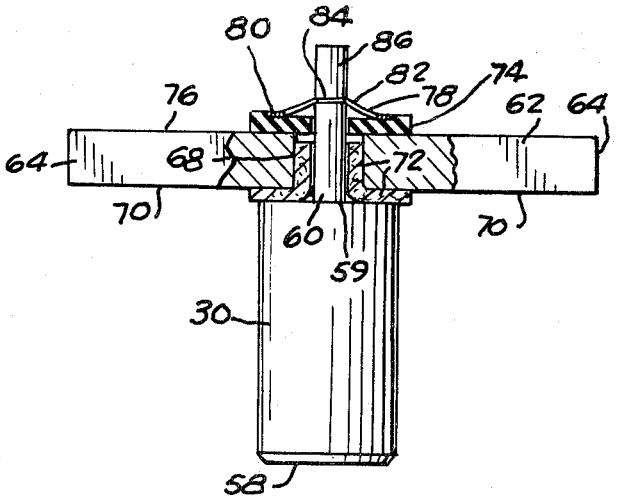
FIG. 18
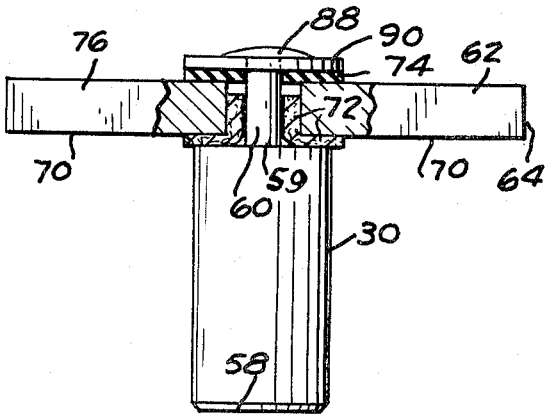
FIG. 19
FIG. 16
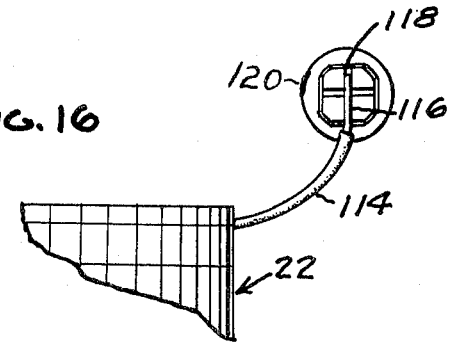
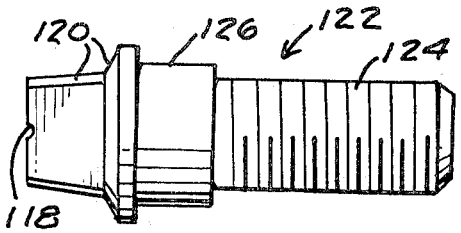
FIG. 17

SWITCH STRUCTURE HAVING PARTS EMBEDDED IN PLASTIC

This application is a division of my copending application Ser. No. 632,405 filed Nov. 17, 1975 now U.S. Pat. No. 4,112,576 and entitled Method of Making a Switch.

This invention relates to a method of making a switch and products of the method. The various features of the invention can be conveniently illustrated with respect to a solenoid actuated relay switch for the starter motor of an internal combustion engine and, accordingly, such a switch is selected for the present disclosure. A typical conventional switch of this type is disclosed in Terry U.S. Pat. No. 3,217,124.

Usually, a starter switch is subjected to engine vibrations whenever the engine is running, and over a period of time these vibrations tend to fatigue, loosen or otherwise damage the switch components. In conventional starter switches the measures taken to minimize the effects of the vibration have left something to be desired.

Conventional starter switches are made by providing a housing of an insulating material, such as a plastic, with holes formed therein to receive the starter motor terminals, contact posts for the solenoid lead wires and a rivet which secures together the bottom of the solenoid casing, the plastic housing and, where desired, a mounting bracket. The solenoid casing is inserted into the housing thus formed; a rivet inserted into the plunger opening within the solenoid coil is projected through aligned bottom openings in the solenoid casing and housing, through the mounting bracket opening and is then staked over.

The motor terminals and solenoid contact posts, which are in the form of bolts, are inserted outwardly through the preformed openings in the housing and nuts are run onto the bolts into tight engagement with the housing exterior. Fluent plastic potting material is applied over the top of the solenoid casing around its plunger opening which, when set, assists in securing the solenoid in position and is intended to provide a moisture-proof seal at the top of the solenoid. The conventional manufacturing procedure involves numerous operations and is thus relatively slow and costly.

The starter motor terminals have heads within the housing whose upper surfaces are contacted by the lower face of a circular contact washer on the solenoid plunger. To obtain proper contact between the washer and terminal surfaces, the terminal surfaces must be flat and oriented accurately in a plane radial of the plunger axis. However, this condition is seldom achieved in assembly of the terminals onto the housing because of the torque applied to the terminals in running the anchor nuts onto them.

Consequently, the upper terminal surfaces must be milled or otherwise machined in order to insure correct orientation. This step adds to the cost of manufacture. Moreover, during the milling operation and during the potting operation, chips of metal and particles of the potting material inevitably become deposited in the plunger opening. This necessitates a thorough cleaning of the opening which further adds to the cost of manufacture. The moisture-proofing intended by the potting material leaves something to be desired, particularly for marine applications.

The object of the present invention is to provide an improved method of switch manufacture which is quicker, simpler and less costly than known methods and which results in a product which can be sold to the consumer at a lower price than conventional switches and which has improved vibration resistance, moisture-proofing and accuracy of position of various components. One form of the invention is illustrated in the accompanying drawings.

FIG. 12 is a sectional view on line 12—12 of FIG. 10.

FIG. 13 is a sectional view on line 13—13 of FIG. 10.

FIG. 14 is a sectional view on line 14—14 of FIG. 13.

FIG. 15 is an exploded view showing the components of a solenoid unit.

FIG. 16 is a fragmentary elevational view of the solenoid casing, a lead wire and contact post.

FIG. 17 is an enlarged scale side elevational view of a solenoid contact post.

FIG. 18 is an elevational view of one form of plunger assembly.

FIG. 19 is an elevational view of another form of plunger assembly.

Figure 1:
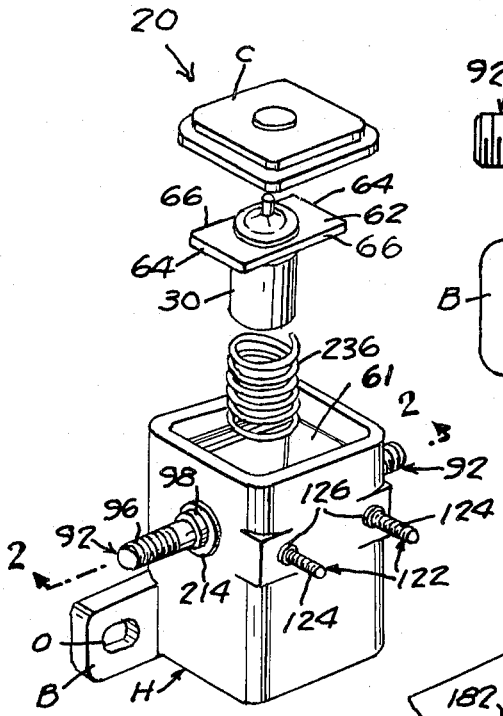
FIG. 1 is an exploded perspective view of a switch according to the present invention.

In the following disclosure such terms as upper, lower, vertical, etc. are used for the sake of convenience in describing various components and movements in the drawings as oriented and no structural limitations are implied thereby.

Shown in the drawings is a switch 20 according to the present invention. The switch comprises a solenoid unit 22 having a coil 24 wound on a bobbin 26 which defines a central opening 28 for receiving an axially movable magnetic plunger 30. Around coil 24 is a magnetic casing 32 formed of a side wall 34, an upper end wall 36 and a lower end wall 38. Wall 36 has a central opening 39 aligned with opening 28 through which plunger 30 extends. Wall 36 has an upper surface 40. Lower wall 38 has a plug or pin 42 staked thereto at 44 and having an upper surface 46 which forms the effective bottom of plunger opening 28. Lower wall 38 has a lower surface 47. Coil 24 has lead wires 46, 48 which extend from the interior of casing 32 through nipples 49 of insulating material to the exterior of the casing through notches 50, 52 in upper end wall 36, nipples 49 fitting within the notches. Side wall 34 has aligned pairs of upper notches 54 and lower notches 56 for intercommunicating the exterior of the casing and a radial space 57 between coil 24 and the interior of wall 34. These notches provide sprue ports or gates for a purpose described below.

Solenoid unit 22 is encapsulated within an injection molded plastic housing H having integral wings which cooperate to form a mounting bracket B provided with openings O for fasteners such as bolts. Housing H defines an internal chamber 61 within which plunger 30 moves, the chamber being closed by a cap C.

Figure 9:
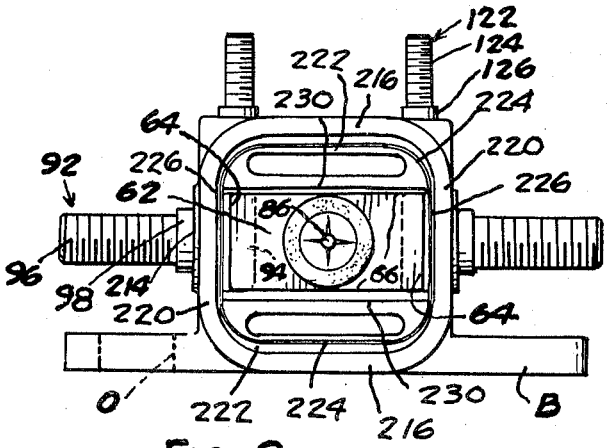
FIG. 9 is a top plan view of the switch with the cover removed.

In the form of switch shown in FIGS. 1 and 18, plunger 30 has a bottom surface 58 and an upper end portion 60 of reduced diameter forming a shoulder 59 and a pin or rod projecting axially therefrom. A non-circular contact member 62 is carried by the plunger. In the illustrated form of the invention, the contact member is rectangular (FIGS. 1 and 9) having a length which terminates in ends 64 and a width shorter than its length which terminates in sides 66. The contact member has a central opening 68 through which post 60 passes and has lower face portions 70 forming electrical contact surfaces. An L-shaped washer-ferrule 72 of insulating material is interposed between surfaces 59, 70 and between opening 68 and post 60. A washer 74 of elastomeric insulating material around post 60 is secured firmly against upper surface 76 of contact member 62 by a Tinnerman fastener 78 whose lower periphery 80 is engaged against washer 74 and whose upper periphery 82 is engaged in an annular notch 84 in rod 60. A portion 86 of the rod projects above notch 84 for a purpose to be described.

The plunger assembly of FIG. 19 is similar to that of FIG. 18 except that rod 60 instead of having an upwardly projecting free end portion 86 is headed at 88 to provide a riveted connection between the plunger and contact member, and a washer 90 is interposed between head 88 and elastomeric washer 74.

Switch 20 includes in the illustrated form of the invention a pair of electric motor terminals 92 each having generally the form of a bolt with a head portion 94, a threaded shank portion 96 and an intermediate unthreaded shank portion 98. Each head 94 is provided with a flat surface 100 for electrical contact with the flat under surfaces 70 of contact member 62. Preferably, each head 94 has non-circular shape in three orthogonal planes as will be seen from a consideration of FIGS. 9, 10 and 11. Preferably, intermediate shank portion 98 has substantially circular sectional shape. Each terminal head 94 has a surface 102 which faces in the opposite direction from contact surface 100.

Head 94 has a thickness between surfaces 100, 102 which is held within a predetermined range of tolerances. Likewise, the axial thicknesses of end walls 36,38 and the axial length of side wall 34 of solenoid housing 32 are held within predetermined tolerances. End walls 36,38, side wall 34 and terminal heads 94 are in axially stacked relation in switch 20. Accumulations of high side tolerances of the stacked components, if left uncompensated, would result in an undesirable distance between bottom 46 of plunger opening 28 and contact surfaces 100 of terminal heads 94. To provide capability for such compensation axially compressible means are provided between bottom surface 47 and contact surfaces 100.

In the form of the invention illustrated the compressible compensating means comprises an axially compressible, fibrous, electrically insulating washer 104 interposed between solenoid unit 22 and terminal heads 94 so that one face 106 of the washer is engaged by upper surface 40 of upper wall 36, and the other face 108 of the washer is engaged by surfaces 102 on heads 94. Functioning and purpose of this arrangement is described in greater detail below. Washer 104 is provided with a pair of holes 110,112 through which solenoid lead wires 46,48 are threaded, is notched at diametrically opposite locations 113 to receive intermediate shank portions 98 of motor terminals 92, and has a central opening 115 for alignment with plunger opening 28.

Each lead wire 46,48 extends exteriorly of solenoid casing 32 as represented at 114 in FIG. 16, and each wire has an end portion 116 which is welded, soldered or brazed within a notch 118 in a head portion 120 of a contact post 122 (FIG. 17). Each post 122 has generally the form of a bolt including a head 120, a threaded shank portion 124 and an intermediate unthreaded shank portion 126 which preferably has circular sectional shape. Preferably, head 120 has non-circular sectional shape in three orthogonal planes as is shown in FIGS. 16 and 17.

In accordance with the invention solenoid unit 22, head and shank portions of motor terminals 92 together with washer 104, head and shank portions of contact posts 122, and wire portions 114 are all firmly embedded and anchored in the common integral body of injection molded plastic material which forms housing H.

Figure 4:
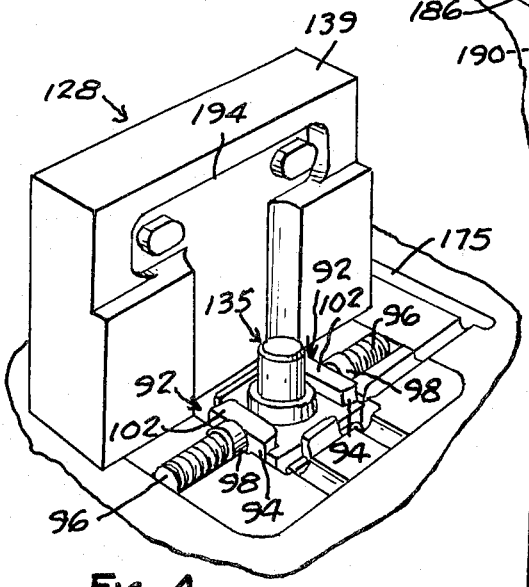
FIG. 4 is a fragmentary view similar to FIG. 3 showing electrical motor terminals positioned on the die.
Figure 5:
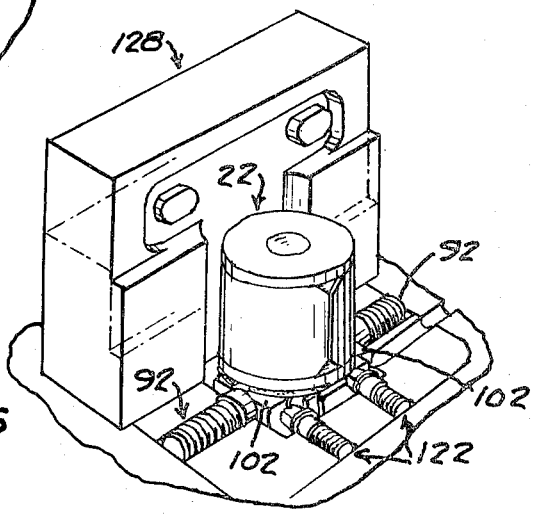
FIG. 5 is a view similar to FIG. 4 showing a solenoid unit and solenoid contact posts added to the die.
Figure 10:
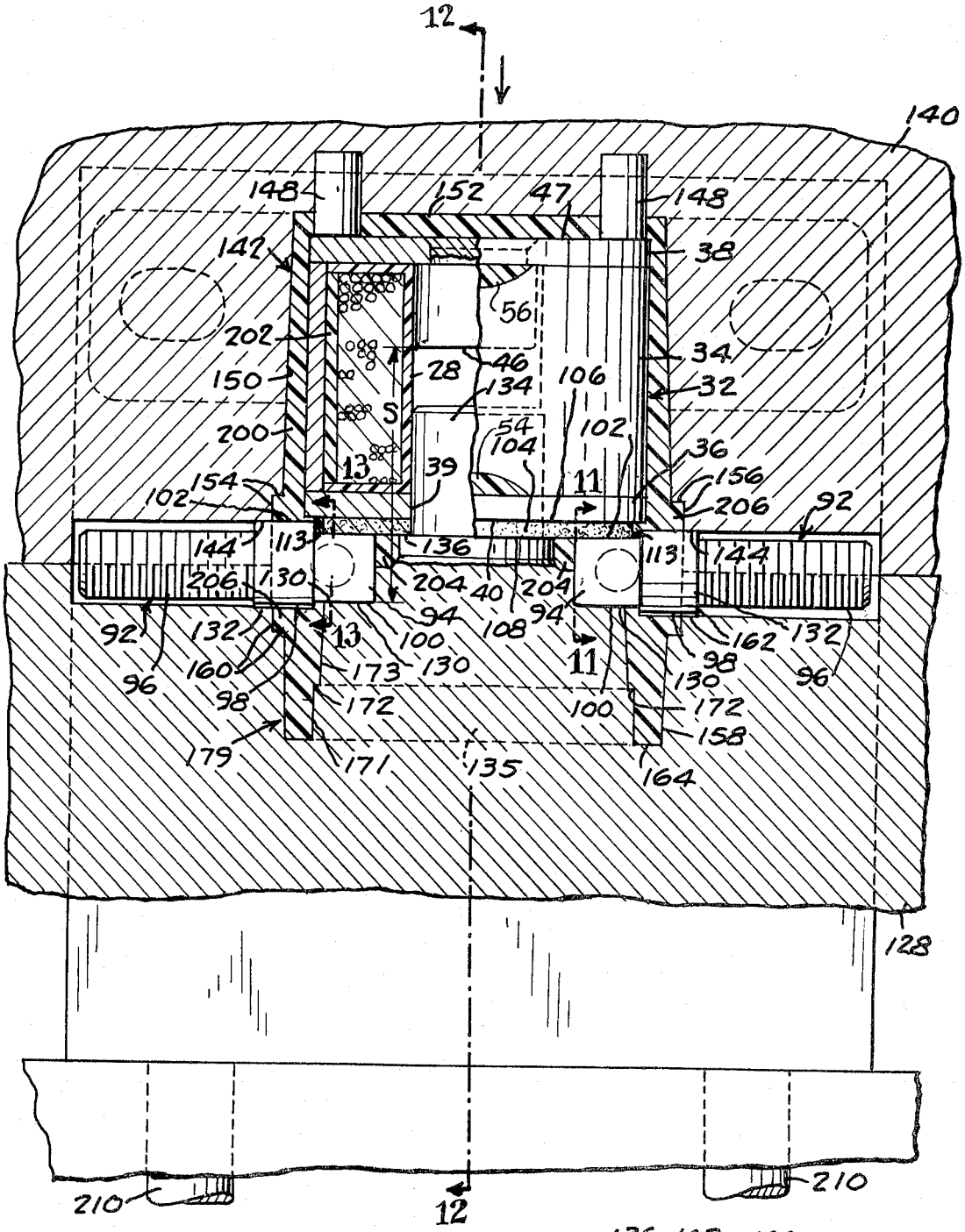
FIG. 10 is an enlarged scale fragmentary sectional view on line 10—10 of FIG. 6 but showing the dies in closed condition.
Figure 11:
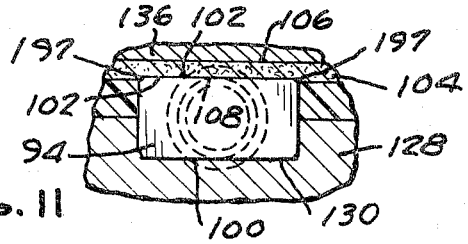
FIG. 11 is a sectional view on line 11—11 of FIG. 10.

To accomplish this motor terminals 92 are first positioned on the lower one 128 of a set of dies with contact surface 100 engaged against a die face 130 and with intermediate shank portion 98 engaged against a die face 132 (FIGS. 4, 10 and 11). Die face 130 fits accurately the flat configuration of contact surface 100 and die face 132 conforms accurately to the circular shape of intermediate shank portion 98. Next, after washer 104 has been assembled to solenoid casing 32 and lead wires 46,48 have been soldered to contact posts 122, solenoid unit 22 is inverted and placed over lower die 128 (FIG. 5) with washer face 108 engaged against surfaces 102 of terminal heads 94 (FIGS. 10 and 11), with intermediate shank portion 98 disposed in washer notches 113 (FIG. 10) and with washer notches 50,52 and washer holes 110,112 (FIG. 15) circumferentially displaced from terminal heads 94.

During this step, a cylindrical portion 134 of a core 135 is inserted into plunger opening 28 through aligned openings 39 and 115 in end wall 36 of the solenoid unit and washer 104 respectively. An annular shoulder 136 at the base of core portion 134 is engaged against face 108 of washer 104 around opening 115. Also during this step, contact posts 122 are positioned in die cavities having die faces 138 (FIGS. 13 and 14) which conform accurately to the configuration of shank portion 126 of the contact posts.

Next, an ejection block 139 forming a part of lower die 128 is lowered and the upper one 140 of the set of dies is lowered over lower die 128. The upper die has a cavity 142 for receiving solenoid unit 22, a pair of die faces 144 (FIGS. 6 and 10) which conform accurately to the configuration of intermediate shank portion 98 of motor terminals 92, and a pair of die faces 146 (FIGS. 6, 13 and 14) which are configured to conform accurately to shank portions 126 of contact posts 122. Within die cavity 142 are a pair of thrust pins 148 positioned for engagement against surface 47 of end wall 38 of the solenoid unit.

As best shown in FIGS. 10 and 12, die cavity 142 has a generally axially extending face 150 which is spaced radially outwardly from and surrounds solenoid casing 32 and a radially extending face 152 spaced axially from surface 47 of end wall 38 of the casing. Pins 148 project from face 152 as shown. Surface 150 is stepped radially outwardly at 154 and 156 adjacent die faces 144. Lower die 128 has a face 158 which forms a continuation of face 150 and which is stepped radially outwardly at 160,162 adjacent die faces 132. Face 158 terminates axially at a laterally extending face 164 from which core 135 projects axially toward the solenoid unit. Core 135 has a radially extending face 168 (FIG. 12) provided with a pair of small cavities 170 which extend continuously along face 168 adjacent its opposite sides. Core 135 has a surface 171 spaced inwardly of face 158 and stepped inwardly to form shoulders 172 which adjoin and lie in the same plane as the bottoms of cavities 170. From shoulders 172, core 135 continues upwardly in a generally axial face 173 which is tapered slightly inwardly and which terminates at die face 130. From there the core steps axially and radially inwardly to adjoin shoulder 136 (FIG. 10). Core 135 has generally axially extending faces 173*a* for a purpose to be described.

Figure 3:
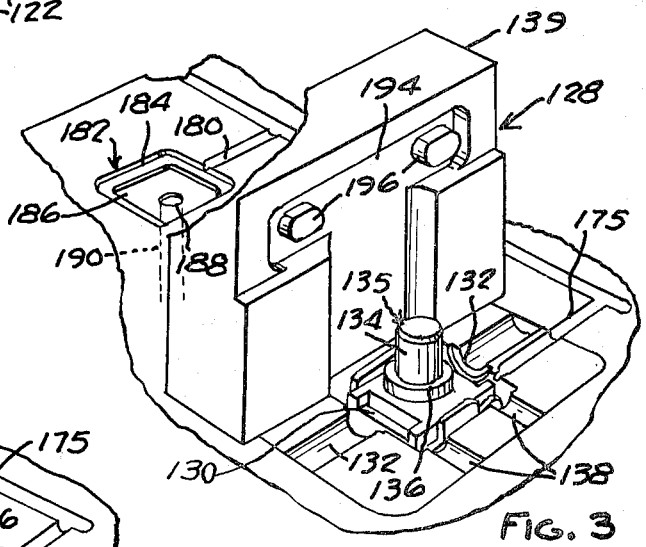
FIG. 3 is a perspective view of a lower injection molding die used in practice of the invention.

The upper and lower dies have cavities 174, 175 respectively which cooperate to form sprue runners and cavities 176,178 which cooperate to form a gate for admitting fluent plastic into cavity 142 and the cavity 179 formed by core 135 and the surrounding faces of lower die 128. The dies also have cavities 180 (only the lower one being shown—FIGS. 3 and 6), forming a gate or branch sprue runner for admitting the plastic into a cavity 182 in lower die 128. This cavity has axially offset radially extending faces 184,186, the latter of which has an axially extending circular recess 188. An ejector pin 190 underlies cavity 182. Ejector block 139 has a die cavity 194 which is a continuation of die cavity 142 and which is provided with cores 196.

When the dies are in closed condition, pins 148 exert thrust axially against end wall 38 of solenoid casing 32, and this thrust is transmitted through the casing and washer 104 to terminal heads 94 causing contact surfaces 100 to engage tightly against die faces 130. Also, face 108 of washer 104 is engaged forcibly against shoulder 136 on core 134. The washer has sufficient axial thickness so that even though the total combined axial tolerance of terminal heads 94 and solenoid casing 32 may be at their minumum, interengagement of washer face 108 and core shoulder 136 is tight enough to prevent plastic from penetrating therebetween into plunger opening 28 during the subsequent molding step.

Any additional accumulation of axial tolerance would tend to increase the distance S (FIG. 10) between bottom surface 46 of the plunger opening and die face 130. However, the thrust of pins 148 is sufficient to compress fibrous washer 104, as shown at 197 in FIG. 11, to the extent necessary to compensate for such additional accumulations of tolerance and insure that prior to the injection step bottom 46 is spaced axially from die face 130 by a distance only slightly greater than the axial distance between end surface 58 of plunger 30 and contact surfaces 70 of contact member 62. The result is that when solenoid 22 is energized, plunger 30 penetrates deeply into opening 28 for maximum magnetic attraction. On the other hand, however, distance S is great enough to prevent plunger bottom 58 from engaging bottom 46 of opening 28 which would interfere with engagement of contact surfaces 70 on the plunger with contact surfaces 100 on the terminals. By way of example, in a typical switch according to the invention, distance S is 0.952 inch and the distance between plunger end 58 and contact surfaces 70 is 0.930 inch. Thus when solenoid 22 is energized and contact surfaces 70,100 are interengaged, plunger end 58 is spaced axially from bottom 46 of the plunger opening by a distance of 0.022 inch.

When the dies are closed, die faces 132,144 forcibly engage around intermediate shank portions 98 of motor terminals 92, and die faces 138,146 forcibly engage around shank portions 126 of contact posts 122. Die cavity 182 is closed by a face 198 on upper die 140.

Fluent plastic is now injected under pressure into sprue runners 174,175, through gates 178,180 and into die cavities 142 and 179 to form housing H, cavity 194 to form bracket B, and cavity 182 to form cap C. The plastic flows into the spaces between die face 150 and side wall 34 and between die face 152 and surface 47 of the solenoid unit to completely encapsulate those portions of the solenoid unit as at 200. The plastic also enters solenoid casing 32 through ports 54,56 (FIG. 12) and into the radial space 57 between core 24 and side wall 34 to completely encapsulate the coil in plastic as at 202. The plastic also encapsulates portions of terminal heads 94 at 204 and portions of intermediate shanks 98 as at 206. The plastic completely embeds the heads 120 and portions of shanks 126 of contact posts 124 as at 208 (FIGS. 13 and 14) along with the portions 114 of head wires 46,48 which extend exteriorly of solenoid casing 32 to the contact posts as well as any exposed portions of the wires within the casing.

Die faces 130 and contact surfaces 100 of the motor terminals are mated so accurately and are interengaged so forcibly that the plastic material is substantially entirely excluded from penetration therebetween. Similarly, the surfaces of terminal shanks 98 and die faces 132,144 are so accurately mated and are so forcibly interengaged that plastic is substantially entirely excluded from penetration therebetween. Similarly also, shanks 126 of contact posts 122 and die faces 138,146 are so accurately mated and so forcibly interengaged that the plastic is substantially entirely precluded from penetrating therebetween.

Figure 8:
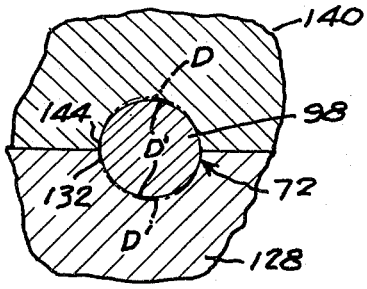
FIG. 8 is an enlarged scale, partly diagrammatic sectional view on line 8—8 of FIG. 6.

To insure lack of penetration of the plastic around shanks 98,126 past die faces 132,144 and 138, 146, the dies grip the shanks with sufficient force to coin the metal of the shanks slightly. This is illustrated in somewhat exaggerated form in FIG. 8 wherein the uncoined diameter D of a shank 98 is shown in broken lines and the coined diameter D′ is shown in solid lines. Shanks 126 are coined in a similar manner. As will be seen from FIGS. 1 and 9, shanks 98 and 126 project exteriorly of housing H to provide lugs for the reception of washers against which electrical terminals can be clamped by nuts threaded onto the shanks.

Figure 6:
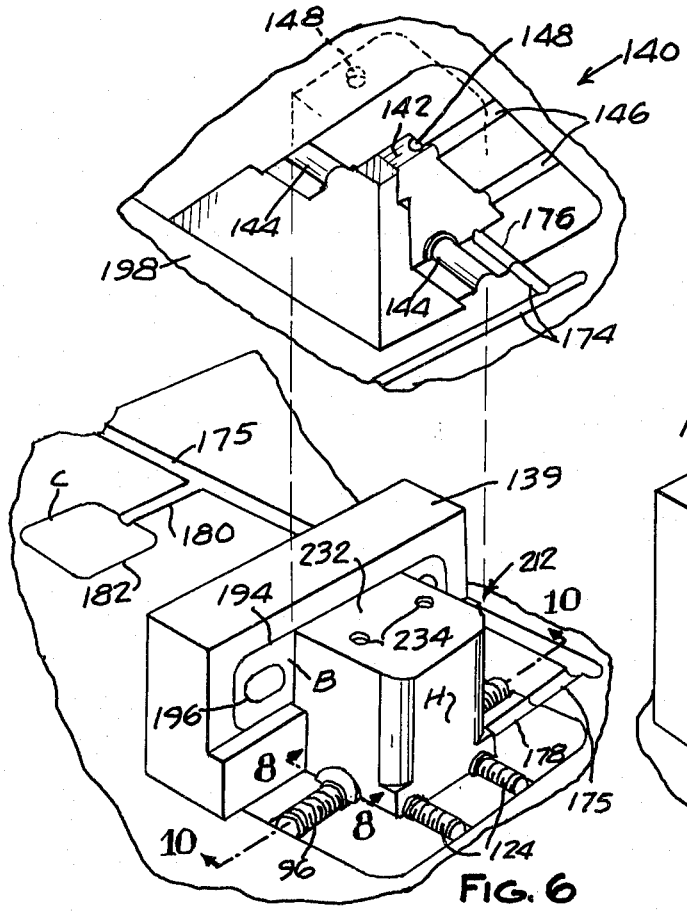
FIG. 6 is a perspective view showing upper and lower dies parted after an injection molding step.
Figure 7:
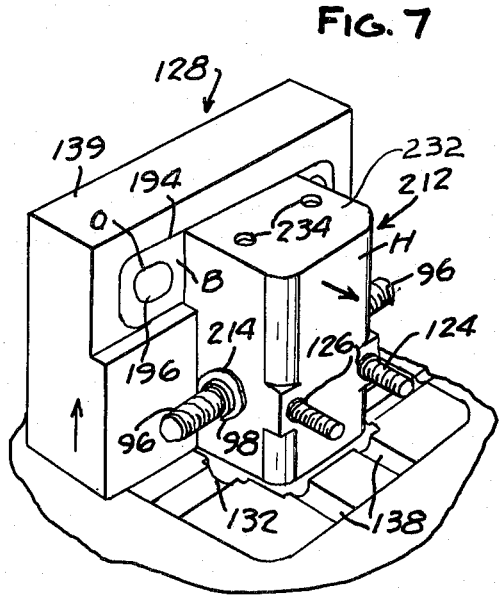
FIG. 7 is a perspective view illustrating ejection of the molded article from the lower die.

After the plastic has set, upper die 140 is removed as in FIG. 6, and ejector mechanism is actuated to elevate ejector pin 190 for ejecting complete cap C from die cavity 182 and for elevating rods 210 which, in turn, raise ejector block 139 which by engagement with mounting bracket B carries the injection molded assembly 212 upwardly away from lower die 128 where it can be removed from the ejection block as represented by the arrows in FIG. 7.

The set plastic retains the accurate axial spacing between bottom 46 of plunger opening 28 and contact surfaces 100 of motor terminals 92. Precluding the plastic from penetration between the various die faces and surfaces of the motor terminals and contact posts engaged thereby has prevented the formation of flash over contact surfaces 100 of the motor terminals and at the exterior of the assembly around shank portions 98 and 126 of the motor terminals and contact posts respectively.

Contact surfaces 100 of the motor terminals are securely anchored flatly in a plane radial of plunger 30 for proper engagement by undersurfaces 70 of contact member 62. Stepped die faces 154, 156, 160, 162 and the taper of core face 173 has resulted in thickening of the plastic portions which surround intermediate shank portions 98 of the terminals and the formation of bosses 214 which reinforce the anchoring capability of the plastic. The anchoring capability of the plastic is further enhanced since the portions of the motor terminals and contact posts embedded therein are non-circular in three orthogonal planes so that it is very difficult to twist or turn the terminals or posts out of correct position.

The plastic material not only forms housing H for solenoid unit 22 but also defines chamber 61 within which the upper portion of plunger 30 and contact member 62 move. The chamber has side walls 216 and end walls 220. Each side wall has a radially thickened portion 222 (FIG. 9) with a small bead or ridge 224 thereon formed respectively by core face 168 and recess 170 (FIG. 12). Each end wall has a small shoulder or ridge 226 formed by core face 172 (FIGS. 10 and 12). Beads 224 integrally adjoin shoulders 226 to form a continuous surface extending in substantially the same plane around peripheral portions of the chamber and facing toward an open end 228 of the chamber. Within the chamber is a pair of walls 230 formed by faces 173*a* of core 135 (FIG. 12). These walls are generally parallel to and spaced radially outwardly of sides 66 of contact member 62. Bracket openings 0 are formed by cores 196.

When upper die 140 is removed, pins 148 are withdrawn from bottom wall 232 of housing H leaving a pair of holes 234 which preferably are subsequently covered, plugged or filled to render the bottom wall moisture-proof. This can be done, for example, by filling the holes with a fluent plastic which will bond with the plastic of housing H and allowing the plastic to set.

In final assembly, plunger 30 is inserted through a coil spring 236 and is inserted through open end 228 of housing H so that plunger 30 enters opening 28 and contact member 62 is positioned between walls 230. Cap C is then inserted into opening 228 and its lower face 238 is engaged against beads 224 and shoulders 226. A moisture-proof connection is formed between face 238 and the beads and shoulders, preferably by fusing or welding the plastic thereof. This can be done by providing a coating of solvent type cement between the interengaged surfaces but preferably it is done by applying energy to the surfaces in the form of ultrasonic vibration and pressure which causes the surfaces to rub against each other, heat, soften and weld together. This can be accomplished by conventional ultrasonic welding equipment. When the welded plastic cools, cap C and housing H (holes 234 having been plugged as described) cooperate to render the interior of switch 20 substantially moisture-proof. This tends to reduce sparking between contact surfaces 70, 100 which in turn tends to reduce the possibility of explosion should the switch be used in a combustiblefume-laden atmosphere such as a motor boat bilge.

In the assembly procedure described in the preceding paragraph there is no necessity for machining contact surfaces 100 of terminals 92 since these surfaces are accurately positioned and oriented during the injection molding steps and there is no necessity for adding potting material to the solenoid since it has already been encapsulated during the molding step. Consequently, the usual source of contaminants for plunger opening 28 has been eliminated and the conventional step of thoroughly cleaning out the opening is unnecessary.

If flash were permitted to form on the exterior portions of terminals 92 and posts 122, it would have to be trimmed away to insure proper electrical contact between the terminals and posts and contacts engaged therewith. As is disclosed above, no such flash is permitted to form and no flash trimming step is necessary.

The plastic of housing H and cap C is preferably tough and relatively non-frangible, a suitable plastic being a polycarbonate. A suitable material for washer 104 is a high density fibrous material and a suitable material for filling holes 234 is an epoxy resin. Movements of dies 128,140, ejector pin 190 and ejector rods 210 are effected by suitable conventional equipment.

In use, terminals 92 are connected into the circuitry of an electric motor and contact posts 122 are connected to a source of electric current. When coil 24 is deactuated the parts of switch 20 are in the solid line position of FIG. 2 with plunger 30 retracted upwardly by spring 236 which is compressed between under surfaces 70 of contact member 62 and an exposed portion of washer face 108.

Figure 2:
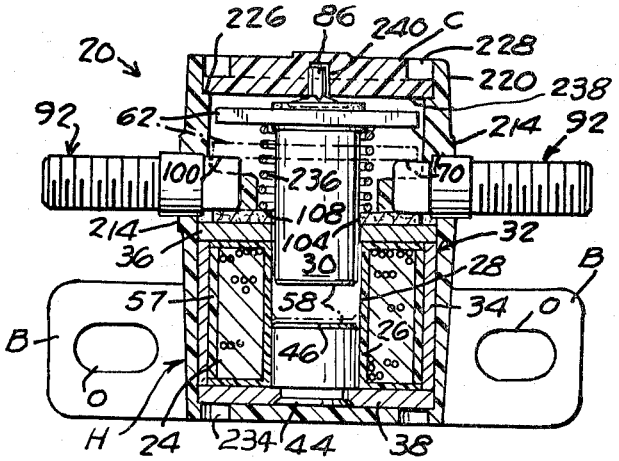
FIG. 2 is a longitudinal sectional view of the switch.

When coil 24 is actuated, plunger 30 is drawn downwardly to the dotted line position of FIG. 2 wherein under surfaces 70 of contact member 62 engage contact surfaces 100 of terminals 92 to close the electric motor circuit. End 58 of the plunger descends to a location closely adjacent bottom 46 of plunger opening 28 to provide an efficient magnetic circuit for interengaging contact surfaces 70,100 properly.

Nevertheless, end 58 is prevented from engaging bottom 46 which would prevent surfaces 70,100 from interengaging properly. This is because the lowermost position of end 58 is determined by the axial location of terminal surfaces 100 and the axial length of plunger 30 between surfaces 70 and end 58; and during the injection molding procedure bottom 46 was accurately positioned an axial distance from surfaces 100 slightly greater than the distance between surfaces 70 and 58. When coil 24 is deactuated, spring 236 returns the plunger and contact member to the upward solid line position of FIG. 2.

Conventional switches have a circular contact member with a diameter which approximates length 66 of contact member 62. Thus rectangular member 62 utilizes less material (usually copper or a copper alloy) and is commensurately cheaper and lighter weight.

During the course of use, plunger 30 tends to rotate about its axis, tending to carry contact surfaces 70 out of alignment with terminal surfaces 100. However, after only insignificant rotation, sides 66 or ends 64 of contact member 62 engage chamber walls 220 or 230, preventing further such rotation and maintaining surfaces 70 in proper alignment with surfaces 100.

In a switch 20 having the form of plunger shown in FIG. 18, pin 86 projects axially into a guide opening 240 molded into the under side of cap C (FIG. 2) by a core pin (not shown) projecting downward from upper die surface 198 into die cavity 182. Interengagement of the pin and opening cooperate with chamber walls 220,230 to guide movements of contact member 62 and therefore of plunger 30. In a switch having the FIG. 19 form of plunger which has no pin 86, walls 220,230 alone guide movements of the contact member and plunger except for a small amount of lateral stability provided by spring 236. In commercial practice of the invention I believe that the FIG. 19 plunger assembly will be preferable since it is the more economical to manufacture and since on the basis of my experience to date it appears that the additional guidance of pin 86 and opening 240 may be unnecessary.

Encapsulation in the plastic of coil 24, solenoid unit 22 as a whole, wires 46,48, and portions of motor terminals 92 and contact posts 122 anchor these parts against vibration relative to each and therefore renders injection molded assembly 212 virtually immune to the effects of vibration of, for example, an internal combustion engine. Since plunger 30, contact member 62, and spring 236 are not usually susceptible to damage from such vibration, switch 20 as a whole is largely vibration proof.

I claim:

1. Switch structure which comprises, a solenoid unit having a casing, a coil therein and a plunger opening within the coil, a plurality of terminals, each terminal having a shank and a head, each head being provided with a contact surface, said unit and portions of said shank and head of each terminal all being embedded in an integral, common body of plastic injection molded therearound, the portions of said plastic molded around said terminal portions of themselves being effective to anchor said terminals so that said surfaces thereof are secured in a predetermined location and orientation relative to said solenoid unit, said plastic having molded therein an opening aligned with said plunger opening, a magnetic plunger movable within said openings and a contact member on said plunger movable to and from engagement with said contact surfaces responsive to actuation and deactuation of said solenoid unit.

2. The structure defined in claim 1 wherein said embedded portion of each head has non-circular sectional shape in three orthogonal planes.

3. The structure defined in claim 1 wherein said contact member has a shape which is non-circular around the axis of said plunger, said plastic having an integral molded wall portion adjacent the path of movement of said contact member, said wall portion being positioned to be engaged by said contact member for restraining the same from rotational movement out of alignment with said contact surfaces.

4. The structure defined in claim 3 wherein said contact member has a length terminating in ends and a width shorter than said length terminating in sides, said housing having one pair of said wall portions which flank said ends and another pair of said wall portions which flank said sides, said wall portions being cooperable to guide axial movement of said contact member toward and away from said contact surfaces.

5. The structure defined in claim 4 wherein said contact member has generally rectangular shape, and said wall portions extend generally parallel and adjacent to the ends and sides of said contact member.

6. The structure defined in claim 5 wherein said contact member is secured to said plunger generally adjacent an end of said plunger opposite from the end disposed within said plunger opening, the first mentioned end during axial movement of said plunger being substantially free of guiding restraint other than that provided by interengagement of said contact member and wall portions.

7. The structure defined in claim 1 wherein said coil has lead wires connected to contact posts, each post having a head portion and a shank portion embedded in said injection molded body of plastic, the portions of said plastic molded around said post portions of themselves being effective to anchor said posts in a predetermined location and orientation relative to said solenoid unit.

8. The structure defined in claim 7 wherein said embedded portion of each post head has non-circular, sectional shape in three orthogonal planes.

9. The structure defined in claim 1 wherein said casing has portions spaced from the windings of said coil, said casing being ported, said body of plastic having portions injection molded through the porting in said casing into said space and into encapsulating relation around said coil.

10. The structure defined in claim 9 wherein said coil has lead wires, portions of which are within said casing and are embedded in the encapsulating portions of said plastic.

11. The structure defined in claim 10 wherein said lead wires have portions outside of said casing, said outside portions being embedded in portions of said plastic which embed said unit.

12. The structure defined in claim 11 wherein each lead wire is connected to a portion of a contact post, said portion of each post being embedded in said plastic.

13. The structure defined in claim 1 wherein said terminals project exteriorly of said body of plastic, the interengagement of said plastic and terminal portions forming a substantially moisture-proof seal therebetween.

14. The structure defined in claim 7 wherein said terminals and contact posts project exteriorly of said body of plastic, the interengagement of said plastic with said terminal portions and post portions forming a substantially moisture-proof seal therebetween.

15. The structure defined in claim 14 wherein said body of plastic defines a chamber in which said plunger and contact member move, said chamber being closed by a cap, said body of plastic and cap having mating surfaces which form a substantially moisture-proof seal.

16. The structure defined in claim 15 wherein said cap surfaces are of a plastic material, said mating surfaces being welded together to form said seal.

17. The structure defined in claim 16 wherein said plastic material is the same as that of said body, said mating surfaces being welded together by the application of pressure and ultrasonic vibration.

18. The structure defined in claim 15 wherein said casing has an end wall through which said plunger opening extends, said casing having an opposite end wall which a portion of said injection molded plastic overlies, said overlying plastic being discontinuous as a result of withdrawal therefrom of means for applying pressure to said opposite end wall during the injection molding, and means forming a substantially moisture-proof seal for excluding penetration of moisture through the discontinuity.

19. The structure defined in claim 18 wherein the latter said means comprises a quantity of fluent plastic material introduced into said discontinuity which has bonded with said injection molded plastic and has cured to hardened condition.

20. The structure defined in claim 2 wherein said contact member is generally rectangular having sides and ends, said body of plastic having integral, molded wall portions defining a chamber within which said plunger and contact member move, said wall portions extending generally parallel and adjacent to the ends and sides of said contact member, said wall portions being cooperable to guide axial movement of said contact member toward and away from said contact surfaces, at least certain of said wall portions being engageable by said contact member for restraining the same from rotational movement out of alignment with said contact surfaces, said casing having portions spaced from the windings of said coil, said casing being ported, said body of plastic having integral portions injection molded through the porting into said space and into encapsulating relation around said coil, said coil having lead wires, portions of which are within said casing and are embedded in said encapsulating portions, said lead wires having portions outside of said casing which are embedded in portions of said plastic body which embed said unit, said outside portions of said lead wires being connected to contact posts having head portions and shank portions embedded in said body of plastic, said embedded portion of each post head having noncircular sectional shape in three orthogonal planes, the portions of said plastic molded around said post portions of themselves being effective to anchor said posts in a predetermined location and orientation relative to said solenoid unit, the interengagement of said portions of said terminals and posts with said plastic forming respectively moisture-proof seals therebetween, a cap closing said chamber, said cap being formed of the same plastic material as that of said body, said cap and body having surfaces welded together to form a substantially moisture-proof seal therebetween.

21. The structure defined in claim 20 wherein said body of plastic has integral molded exterior portions which form a mounting bracket.

22. The structure defined in claim 1 wherein said unit has a length axial of said coil within a predetermined range of axial tolerance, each of said terminal heads having an axial thickness between said contact surface and an opposite surface which is within a predetermined range of axial tolerance, axially compressible means located axially between said contact surfaces and the end of said unit remote therefrom, said remote end having means which defines the bottom of said plunger opening, said contact member having contact face portions which engage said contact surfaces, said plunger having an end face located at a known distance from said face portions, said compressible means being axially compressed to the extent necessary to compensate for cumulative axial tolerances of said unit and terminal heads so that said bottom of said plunger opening is positioned axially from said contact surfaces by a distance only slightly greater than said known distance, said body of plastic by engagement with said terminals and casing retaining said compressible means in said compressed condition.

23. The structure defined in claim 22 wherein said compressible means is disposed between said opposite faces of said terminal heads and an end portion of said casing proximal to said terminal heads.

24. The structure defined in claim 23 wherein said compressible means comprises fibrous material.

25. The structure defined in claim 24 wherein said fibrous material is engaged at one side by said opposite surfaces and at the other side by said proximal end portion of said casing.

26. The structure defined in claim 25 wherein said fibrous material is washer-shaped having a central opening aligned with said plunger opening.

27. The structure defined in claim 20 wherein said unit has a length axial of said coil within a predetermined range of axial tolerance, each of said terminal heads having an axial thickness between said contact surface and an opposite surface which is within a predetermined range of axial tolerance, said contact member having contact face portions which engage said contact surfaces, said plunger having an end face located at a known distance from said face portions, said unit having one end proximal to said terminal heads and another end remote therefrom, said other end having means which define the bottom of said plunger opening, an axially compressible washer of fibrous material engaged at one side by said opposite surfaces of said heads and engaged at the other side by said one end of said unit, said washer being axially compressed to the extent necessary to compensate for cumulative axial tolerances of said unit and terminal heads so that said bottom of said plunger opening is positioned axially from said contact surfaces by a distance only slightly greater than said known distance, said body of plastic by engagement with said terminals and said casing retaining said washer in said compressed condition.

28. In a solenoid switch of the type having a housing made of molded plastic or the like, a solenoid unit fastened in said housing and having a coil therein with an axial opening therethrough, a lead wire on said coil, a terminal post electrically connected to said lead wire and secured to said housing, a pair of main contacts secured to said housing and a contact plunger having a contact plate and a plunger portion, said plunger portion being axially movable in said opening of said coil so that when the solenoid is actuated said contact plate makes an electrical connection between said main contacts, that improvement wherein said solenoid unit and said main contacts are so embedded in plastic integrally molded with said molded plastic housing that the embedding plastic forms anchor means effective of itself to rigidly secure said solenoid unit and said main contacts on said housing.

29. The improvement set forth in claim 28 wherein said main contacts are terminal screws, each of which has a head thereon arranged and disposed to make electrical contact on surfaces thereof with said contact plate when said solenoid is actuated, and wherein said terminal head contact surfaces are nonmachined surfaces.

30. The improvement set forth in claim 28 wherein said lead wire and said terminal post are also so embedded in plastic integrally molded with said molded plastic housing.

31. In a solenoid switch of the type having a housing made of molded plastic or the like, a solenoid unit fastened in said housing and having a coil therein with an axial opening therethrough, a lead wire on said coil, a terminal post electrically connected to said lead wire and secured to said housing, a pair of main contacts secured to said housing and a contact plunger having a contact plate and a plunger portion, said plunger portion being axially movable in said opening of said coil so that when the solenoid is actuated said contact plate makes an electrical connection between said main contacts, that improvement wherein said solenoid unit and said main contacts are at least partially embedded in plastic integrally molded with said molded plastic housing so as to rigidly secure said solenoid unit and said main contacts on said housing, said solenoid unit including an axially walled casing open at one end thereof, said main electrical contacts being in alignment axially of said casing with said axial walls thereof and being spaced from said open end of said casing, and deformable means located in the axial space between said axial wall and said contacts and being compressed in a direction axially of said casing in those areas that are in alignment with said casing and said main contacts.

32. The improvement set forth in claim 31 wherein said main contacts are a pair of headed metal screws, said casing is metallic, and wherein said deformable means is a generally annular washer made of insulating material, one face of said washer being engaged with said casing and the other face of said washer being engaged with said contacts.

* * * * *